US008540442B2

(12) United States Patent
Yap et al.

(10) Patent No.: US 8,540,442 B2
(45) Date of Patent: Sep. 24, 2013

(54) ADJUSTABLE PRINT MEDIA PATH SYSTEM AND METHOD

(75) Inventors: Yaw Horng Yap, Singapore (SG); Soon Ling Tan, Singapore (SG); Shao Hwa Lee, Singapore (SG)

(73) Assignee: Brady Worldwide, Inc., Milwaukee, WI (US)

( * ) Notice: Subject to any disclaimer, the term of this patent is extended or adjusted under 35 U.S.C. 154(b) by 280 days.

(21) Appl. No.: 12/847,033

(22) Filed: Jul. 30, 2010

(65) Prior Publication Data

US 2012/0027493 A1 Feb. 2, 2012

(51) Int. Cl.
*B41J 15/04* (2006.01)
*B65H 57/12* (2006.01)

(52) U.S. Cl.
USPC ..... 400/611

(58) Field of Classification Search
USPC ..... 400/250, 611, 613, 613.1, 615.2, 400/617, 619, 88, 109, 109.1, 247
IPC .. B41J 15/18, 23/04; B41F 17/10; B65H 57/12, B65H 23/04
See application file for complete search history.

(56) References Cited

U.S. PATENT DOCUMENTS

| | | | | |
|---|---|---|---|---|
| 5,435,657 | A * | 7/1995 | Pearce et al. | 400/208 |
| 5,448,348 | A * | 9/1995 | Azeta | 399/364 |
| 5,556,213 | A | 9/1996 | Kudo et al. | |
| 6,142,688 | A | 11/2000 | Saito | |
| 7,376,364 | B2 * | 5/2008 | Fujita | 399/16 |
| 7,806,608 | B2 | 10/2010 | Saito et al. | |

FOREIGN PATENT DOCUMENTS

| | | | |
|---|---|---|---|
| EP | 0 768 611 | A2 | 4/1997 |
| JP | 05084995 | | 4/1993 |
| JP | 08238821 | | 9/1996 |
| JP | 09207417 | | 8/1997 |
| JP | 10006570 | A2 | 1/1998 |
| JP | 10006593 | A2 | 1/1998 |
| JP | 11227276 | | 8/1999 |
| JP | 2000254891 | | 9/2000 |
| JP | 2000263866 | | 9/2000 |
| JP | 2000263868 | | 9/2000 |
| JP | 2001277183 | | 10/2001 |
| JP | 2002137864 | | 5/2002 |
| JP | 2002254385 | | 9/2002 |
| JP | 2002254716 | | 9/2002 |
| JP | 2002255416 | * | 9/2002 |
| JP | 2002255419 | * | 9/2002 |
| JP | 2002255434 | | 9/2002 |
| JP | 2003181791 | | 7/2003 |
| JP | 2003251879 | A | 9/2003 |
| JP | 2005134674 | | 5/2005 |
| JP | 2005324404 | | 11/2005 |
| JP | 2006027238 | | 2/2006 |
| JP | 2007111872 | | 5/2007 |

OTHER PUBLICATIONS

International Search Report & Written Opinion for PCT/US2011/045039, Nov. 18, 2011.

* cited by examiner

*Primary Examiner* — Daniel J Colilla
*Assistant Examiner* — Ruben Parco, Jr.
(74) *Attorney, Agent, or Firm* — Quarles & Brady LLP

(57) ABSTRACT

An adjustable print media path system and method are disclosed. In one form, the print media path system incorporates a frame and a guide member that is moveably coupled to the frame between a cartridge position and an external media position. Inserting print media into the receptacle moves the guide member between the external media position and the cartridge position, thereby adjusting the print media path.

19 Claims, 8 Drawing Sheets

ADJUSTABLE PRINT MEDIA PATH SYSTEM AND METHOD

CROSS REFERENCES TO RELATED APPLICATIONS

Not Applicable.

STATEMENT REGARDING FEDERALLY SPONSORED RESEARCH

Not Applicable.

BACKGROUND OF THE INVENTION

The present invention relates to an adjustable print media path system and method, and more particularly to a system for a printer that is adjustable to accommodate print media of various form factors used in the printer.

Printers have been developed to print on a wide variety of media, such as adhesive backed labels and tubing. To aid the transition from one print media to another, some printers are configured to receive print media cartridges having an interchangeable form factor, regardless of the print media contained therein. These print media cartridges are easily installed into a printer, replaced when empty, and exchanged as desired.

Some printers can be configured to use both print media housed on a print media cartridge or fed into the printer from a separate external container. For example, tubing is available in various diameters and wall thicknesses, often requiring a relatively large roll (as compared to the printer) to house a desirable amount of print media. This external roll arrangement eliminates the numerous print media cartridge changes that would be required if the tubing is housed in a print media cartridge loaded into the printer. However, changing the source of the print media, for example from a print media cartridge to an external print media roll, often requires that the internal media path defined by the internal components of the printer be manually adjusted. Other printers required the insertion or removal of separate attachments to establish the desired path of the print media through the printer.

In many instances, the engagement between the print media and internal drive rollers, pinch rollers, and the like influences the operation of the printer, and more specifically, the feeding of the print media through the printer. An incorrect print media path may result in poor-quality printing, jamming of print media, and increased wear of the internal components.

Therefore, a need exists for an improved print media path system that is capable of use in a printer.

SUMMARY OF THE INVENTION

In one aspect, an adjustable print media path system, capable of use in a printer, comprises a frame defining a receptacle, a print media cartridge configured to be insertable into the receptacle, a cartridge engagement surface coupled to the print media cartridge, a guide member moveably coupled to the frame between a cartridge position and an external media position, a guide engagement surface coupled to the guide member, and a biasing member urging the guide member toward the external media position. Inserting the print media cartridge into the receptacle engages the cartridge engagement surface and the guide engagement surface, thereby moving the guide member toward the cartridge position against the urging of the biasing member.

In another aspect, a method of adjusting a print media path system comprises providing a printer, comprising a frame and a guide member moveably coupled to the frame between a cartridge position and an external media position. Inserting print media into the printer moves the guide member between the external media position and the cartridge position.

These and still other aspects will be apparent from the description that follows. In the detailed description, preferred example embodiments will be described with reference to the accompanying drawings. These embodiments do not represent the full scope of the invention; rather the invention may be employed in other embodiments. Reference should therefore be made to the claims herein for interpreting the breadth of the invention.

DETAILED DESCRIPTION OF THE PREFERRED EXAMPLE EMBODIMENT

An example adjustable print media path system will be described in combination with an example label printer. However, as one skilled in the art will appreciate, the example adjustable print media path system may be modified for use in a variety of different types and styles of printers, such as those manufactured by Brady Worldwide, Inc. of Milwaukee, Wis.

Figure 1:
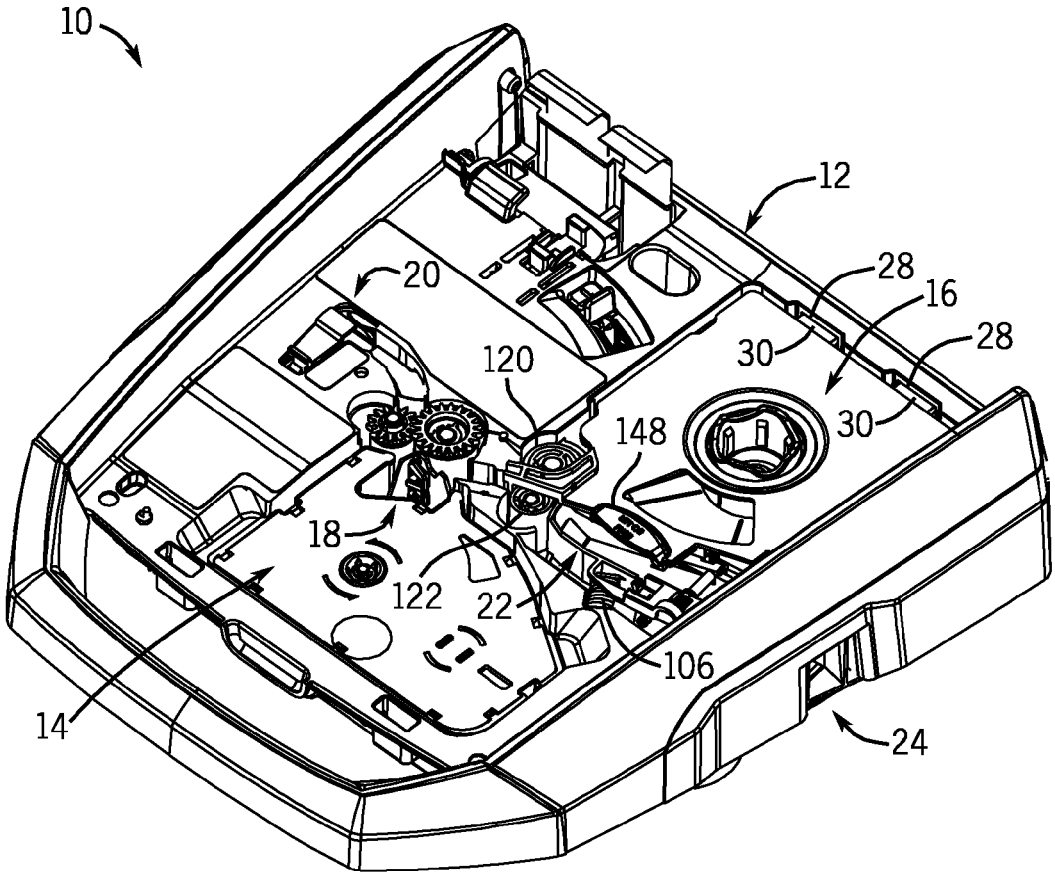
FIG. 1 is a partial isometric view of a printer incorporating an example adjustable print media path system.

An example printer in the form of a label printer (10) is illustrated in FIG. 1. The top cover (including the printer controls) is removed to show the basic arrangement of the various components within the label printer (10). The label printer (10) generally includes a frame (12) supporting a ribbon cartridge (14), a print media cartridge (16), a print head assembly (18), a cutter assembly (20), and an example adjustable print media path system ("path system (22)"). The example print media cartridge (16) and the example ribbon cartridge (14) are selectively removable from the frame (12) of the label printer (10) to facilitate removal and replacement.

Print media (not shown), such as adhesive-backed labels, tubing, paper, plastic wire marker sleeves, and the like, is fed adjacent the print head assembly (18) as it is either unwound from the print media cartridge (16) or inserted into the label printer (10) via the external media input passage (24). The print head assembly (18) interacts with the ribbon cartridge (14) to print upon the print media. The print media is then directed downstream toward the cutter assembly (20) whereat the print media may be cut or scored before being directed out of the label printer (10) through a media output passage (not shown).

As one skilled in the art will appreciate, the overall control and operation of the label printer (10) may be in accordance with standard printer design, with any modifications necessary to implement the inventive concepts. For instance, a controller may be incorporated to control the operation of various motors in response to sensors and instructions programmed through the printer controls. In another version, the label printer (10) may be in communication with a separate device (e.g., a portable computer or hand-held device) to receive any number of commands or instructions.

Figure 2:
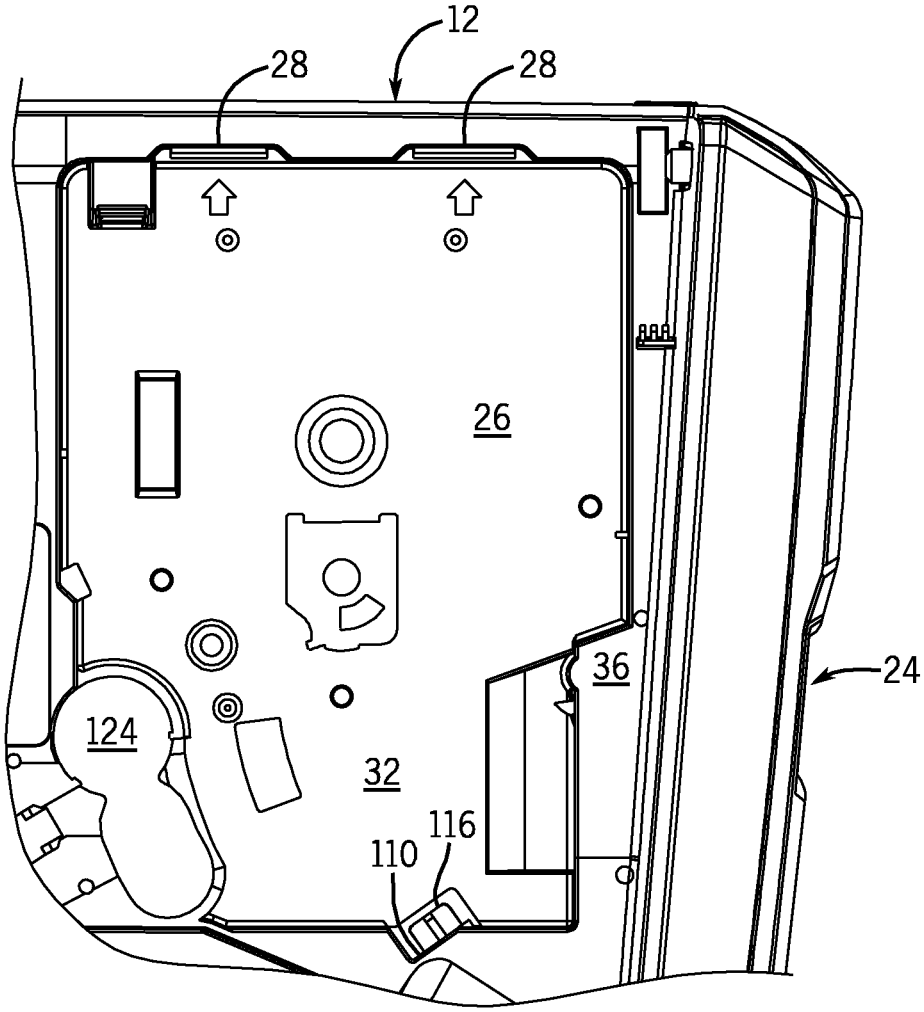
FIG. 2 is plan view of an example receptacle for receiving the example adjustable print media path system.

A portion of the frame (12) is shown in FIG. 2 with the print media cartridge (16) and path system (22) removed to illustrate an example receptacle (26) defined by the frame (12). The frame (12) and receptacle (26) may be formed or constructed of any suitable material, such as plastic or metal. The receptacle (26) is contoured to receive a mating print media cartridge (16) and includes interlocking features, such as pockets (28) that engage tabs (30) extending from the print media cartridge (16), best shown in FIG. 7. In the example embodiment, the receptacle (26) includes a portion (32) into which the path system (22) is generally housed when coupled to the frame (12), as will be described below.

Figure 9:
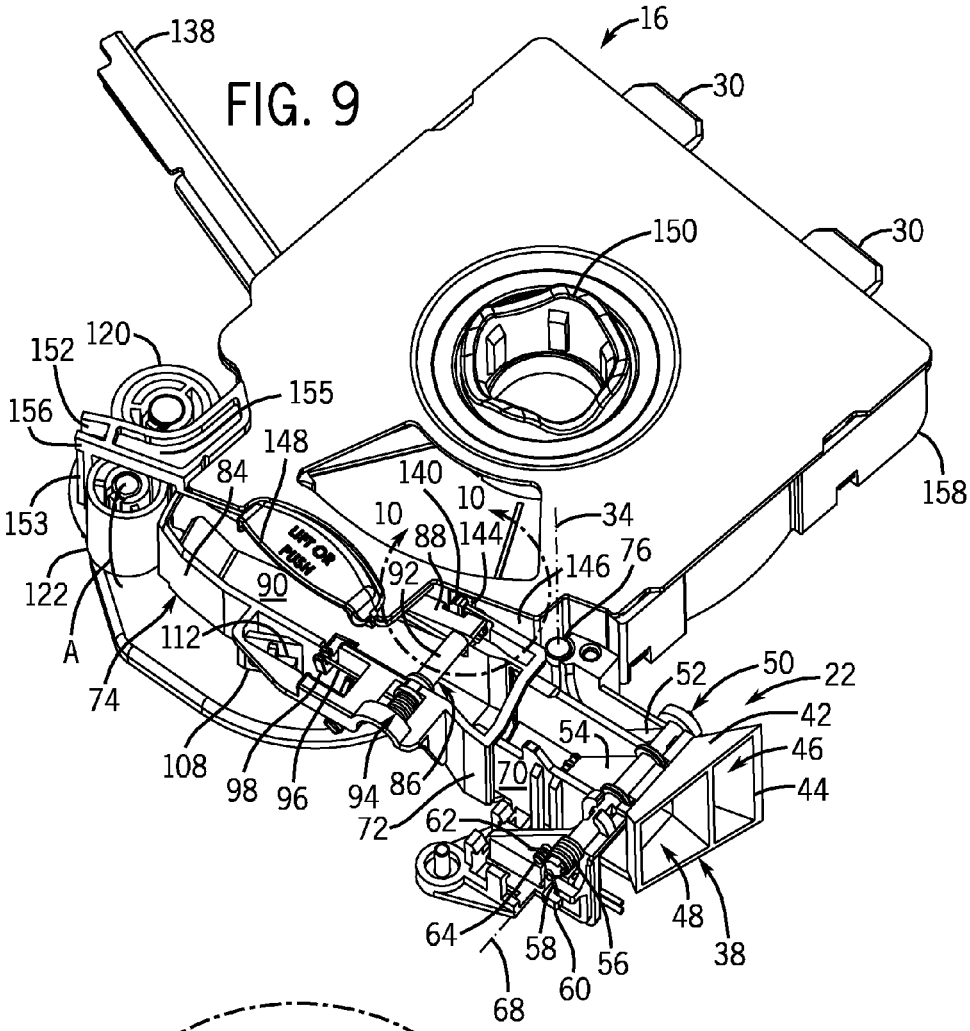
FIG. 9 is an isometric view of the example print media cartridge engaged with the example guide member.

With additional reference to FIGS. 3 through 6, the example path system (22) is shown pivotally coupled to the frame (12) about a path system axis (34) (best shown in FIGS. 4 and 5), such that the path system (22) pivots about the path system axis (34) between an external media position (shown in FIG. 3) and a cartridge position (shown in FIG. 9). When the path system (22) is in the external media position, print media may be fed into the external media input passage (24) and through the path system (22) where the print media is guided by the path system (22) toward the print head assembly (18). When the print media cartridge (16) is inserted in the receptacle (26), the path system (22) is urged into the cartridge position to allow the print media housed in the print media cartridge (16) to be fed into the print head assembly (18) without engaging the path system (22).

The path system (22) is pivotally captured between a lip (36) of the frame (12) (best shown in FIG. 3) and an inlet member (38) that is coupled to the frame (12). The inlet member (38) includes feet (40) (best shown in FIG. 5) that are secured to the frame (12), such as by screws. As best illustrated in FIG. 9, an upstream end (42) of the inlet member (38) includes a flared opening (44) that defines passages (46, 48) for receiving print media of various sizes and form factors from an external print media spool, cartridge, or the like. An upstream media restraint member (50) is pivotally coupled to the inlet member (38) near the upstream end (42) and includes fingers (52, 54) that are urged into the respective passages (46, 48) by a biasing member in the form of a torsion spring (56). The torsion spring (56) has a first end (58) engaged with a U-shaped seat (60) formed in the inlet member (38) and a second end (62) engaged with a pin (64) formed in an arm (66) extending from the upstream media restraint member (50). As a result, the inlet member (38) is fixed to the frame (12) and the upstream media restraint member (50) is pivotally coupled to the inlet member (38) about an axis (68).

In the example embodiment, the path system (22) is positioned adjacent a downstream end (70) of the inlet member (38), such that an upstream end (72) of the path system (22) receives the downstream end (70) of the inlet member (38). Specifically, the path system (22) includes a guide member (74) having a post (76) that is sized to rotatably engage an opening (78) formed proximate the downstream end (70) of the inlet member (38). As noted, the lip (36) of the frame (12) (shown in FIG. 3) captures the post (76) such that the guide member (74) is pivotally engaged with the inlet member (38) about the path system axis (34).

In the example embodiment, the guide member (74) defines print media passages (80, 82) between the upstream end (72) and a downstream end (84) of the guide member (74). The illustrated print media passages (80, 82) are shown of varying size to accommodate print media of different form factors. A media restraint member (86) is pivotally coupled to the guide member (74) near the upstream end (72) and includes fingers (88, 90) extending from a post (92) that are urged into the respective print media passages (80, 82) by a biasing member in the form of a torsion spring (94). The torsion spring (94) has a first end (96) engaged with a U-shaped seat (98) formed in one of the fingers (90) and a second end (100) engaged with a U-shaped seat (102) formed in an arm (104) extending from the guide member (74). The media restraint member (86) inhibits undesirable movement of the print media as it travels along the print media passages (80, 82).

Returning to FIG. 3, the path system (22) is illustrated in the external media position such that print media can be fed through the external media inlet member (38) and into the guide member (74) along the print media passages (80, 82). A biasing member, in the form of a compression spring (106) is positioned between a lower face (108) of the guide member (74) (as viewed in FIG. 3) and a landing (110) formed in the frame (12). Specifically, the lower face (108) of the guide member (74) defines a protrusion (112) configured to restrain one end (114) of the compression spring (106), and the landing (110) defines a similar protrusion (116) configured to restrain the other end (118) of the compression spring (106). As a result, the compression spring (106) is captured between the guide member (74) and the landing (110) to urge the guide member (74) of the path system (22) toward the external media position shown in FIG. 3. Given the benefit of this disclosure, one skilled in the art will appreciate the variety of biasing members capable of urging the guide member (74) toward the external media position. For example, the biasing member may comprise an extension spring, a torsion spring, a motor, or a resilient polymer.

When the path system (22) is in the external media position, the print media is fed through the label printer (10) with the aid of a drive roller (120) and pinch roller (122) that extend through an opening (124) formed in the receptacle (best shown in FIG. 2). The drive roller (120) is operationally engaged with a motor (not shown), such as a step motor, and the pinch roller (122) is biased toward the drive roller (120) (e.g., by an extension spring) such that print media is drawn between the drive roller (120) and the pinch roller (122), and fed toward the print head assembly (18) by the drive roller (120). As one skilled in the art will appreciate, a variety of arrangements are available to feed print media through the example label printer (10), or any other type of printer.

While not required, desirable operation of the path system (22) when in the external media position is enhanced by maintaining a preferred orientation of the guide member (74), drive roller (120), and pinch roller (122). With continued reference to FIG. 3, an engagement plane (126) is defined between the drive roller (120) and the pinch roller (122) and is oriented substantially perpendicular to a plane (128) extending between an axis (130) of the drive roller (120) and a parallel axis (132) of the pinch roller (122). The guide member (74) oriented in the external media position defines an external media path (134) along either of the print media passages (80, 82), depending upon the routing of the print media. An entry angle (136) is defined between the external media path (134) and the engagement plane (126). Maintaining the entry angle (136) at approximately less than fifteen degrees reduces the tendency of certain print media (e.g., tubing) to jam as it is directed past the pinch point between the drive roller (120) and the pinch roller (122).

In the example embodiment shown, the guide member (74) includes two print media passages (80, 82) that are configured to accommodate print media of various size, such as a flattened, smaller diameter tube in the smaller print media passage (80) and a round, larger diameter tube in the larger print media passage (82). In either scenario, the guide member (74) may be oriented to maintain the preferred entry angle (136). Therefore, the preferred orientation of the print media is established by the guide member (74) during normal use, without any secondary configuration, such as manual adjustment by a user. As one skilled in the art will appreciate, a single print medial passage or multiple print media passages may be incorporated into the guide member (74) as desired.

Figure 3:
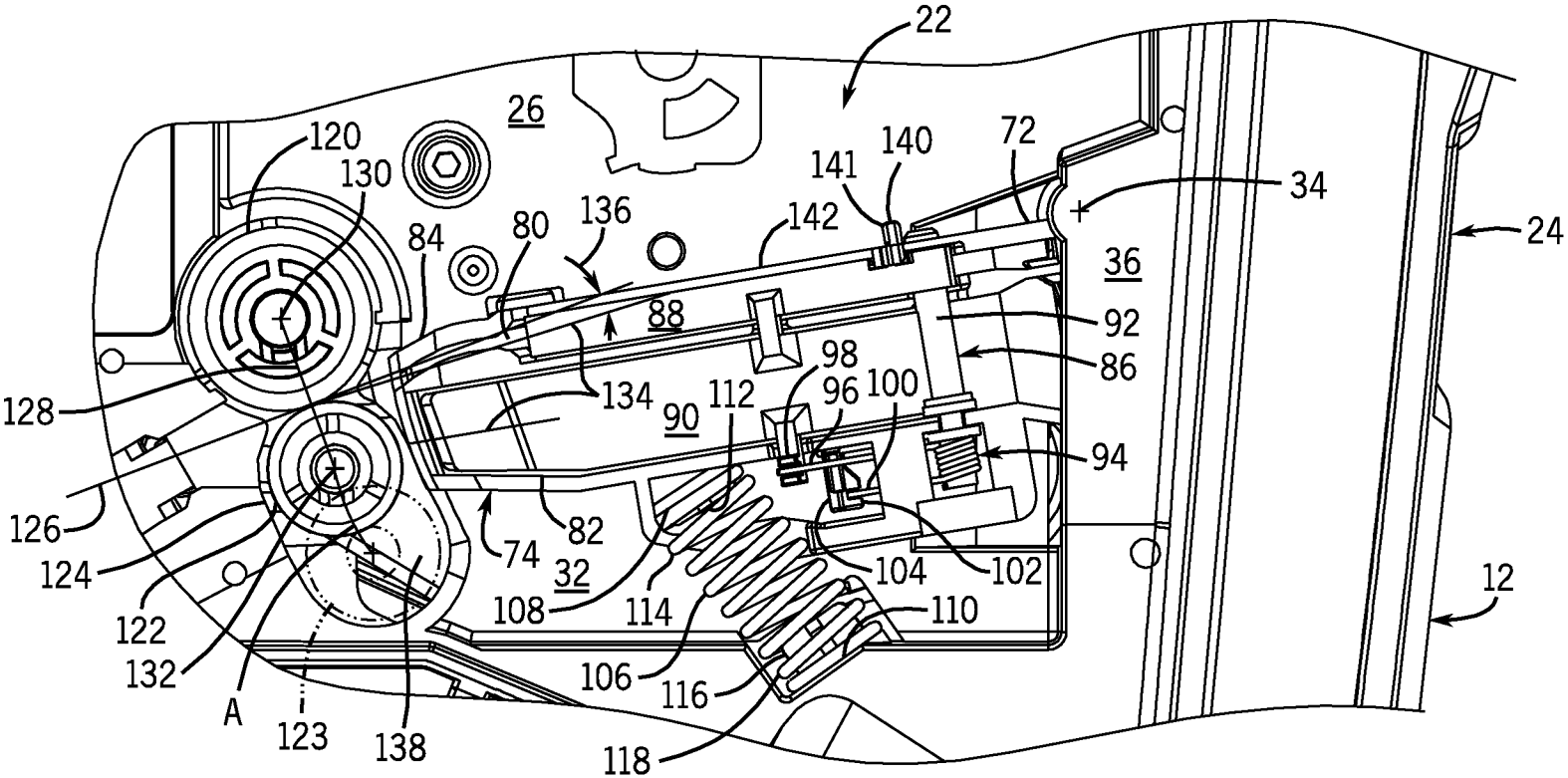
FIG. 3 is plan view of the example adjustable print media path system seated in the example receptacle of FIG. 2.
Figure 4:
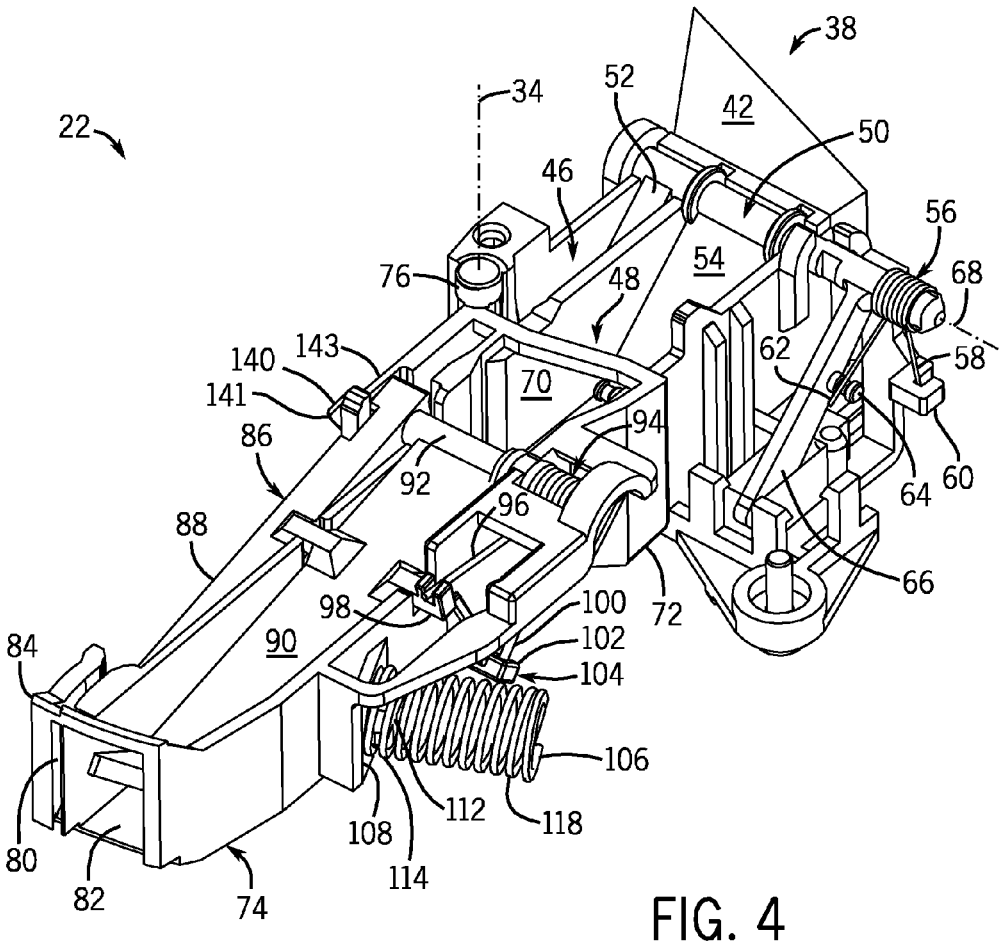
FIG. 4 is an isometric view of an example guide member and an example inlet member for use in the example adjustable print media path system.
Figure 5:
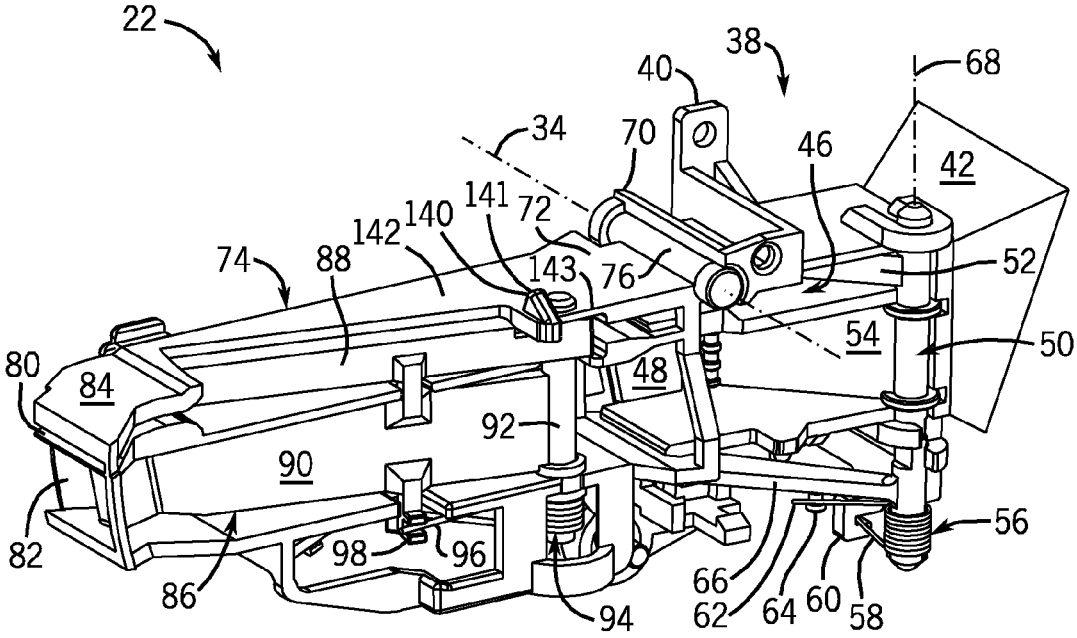
FIG. 5 is an isometric view of the example guide member and the example inlet member of FIG. 4.
Figure 6:
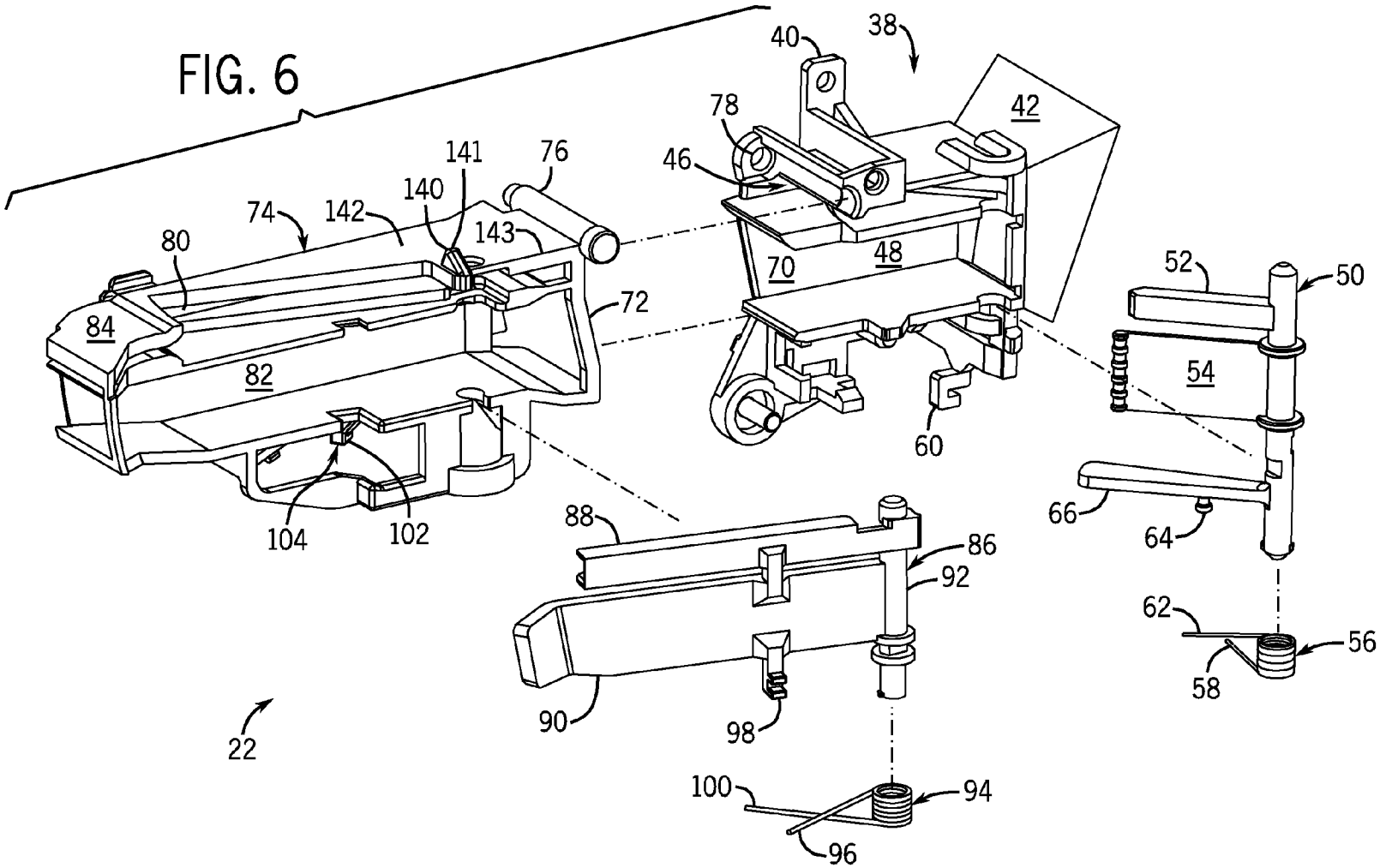
FIG. 6 is an exploded isometric view of FIG. 5.

When a larger print media is fed through the larger print media passage (82), the pinch roller (122) is urged downward and thus spaced apart from the drive roller (120), as shown by the dashed pinch roller (123) in FIG. 3. Specifically, and with additional reference to FIG. 9, the pinch roller (122) is rotatably secured to a J-shaped pivot arm (138) such that the pivot arm (138) moves the pinch roller (122) in an arcuate path generally along the arc (A) shown in FIGS. 3 and 9. The pivot arm (138) is preferably pivotally coupled to the frame (12) and biased to urge the pinch roller (122) toward the drive roller (120), thereby maintaining desired pressure between the drive roller (120) and the pinch roller (122) as print media is fed through the label printer (10), regardless of size. Thus the parallel axis (132) of the pinch roller (122) is moveable relative to the axis (130) of the drive roller (120) in response to the requirements of a particular print media.

Advantageously, the example path system (22) is configured such that inserting the print media cartridge (16) will move the guide member (74) away from the external media position toward the media cartridge position, against the urging of the biasing member (e.g., the compression spring (106)). In the example embodiment shown, the guide member (74) includes a guide engagement surface (140) integral with a top face (142) of the guide member (74), best shown in FIGS. 3, 5, and 6. The example guide engagement surface (140) is shown as a protrusion having a generally triangular profile that ramps away from the top face (142) from an edge (143) of the top face (142).

Figure 7:
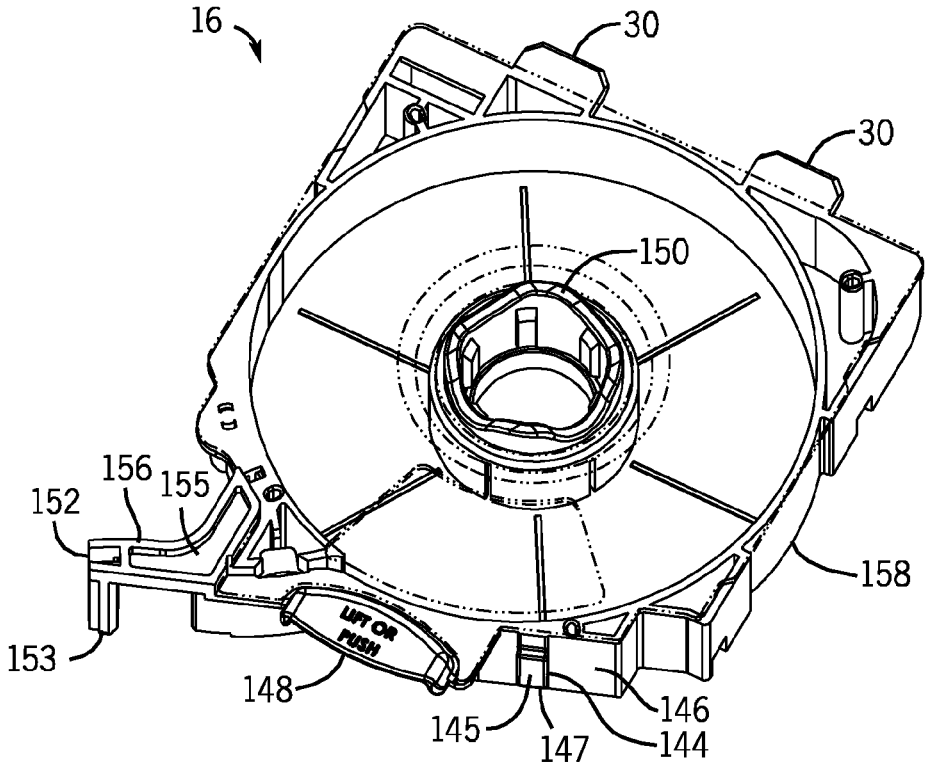
FIG. 7 is an isometric view of an example print media cartridge for use in the example adjustable print media path system.
Figure 8:
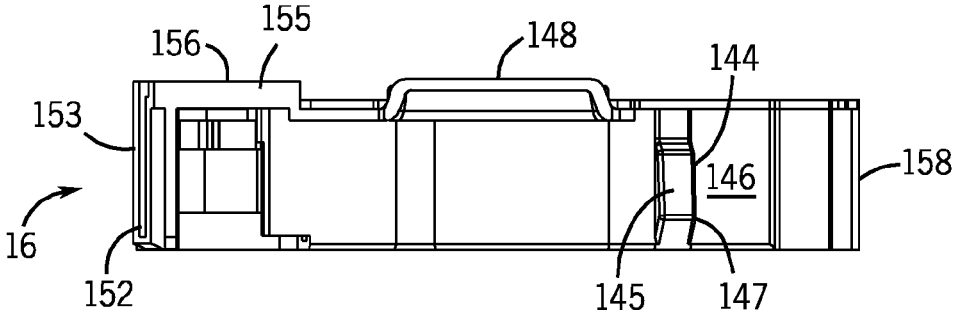
FIG. 8 is a side view of the example print media cartridge of FIG. 7.

With specific reference to FIGS. 7 and 8, the example print media cartridge (16) includes a mating cartridge engagement surface (144) in the form of a contoured protrusion extending from a side (146) of the print media cartridge (16) defining a land surface (145). The cartridge engagement surface (144) is oriented such that when the print media cartridge (16) is seated in the receptacle (26), the guide engagement surface (140) is biased toward the land surface (145) of the cartridge engagement surface (144).

Figure 10:
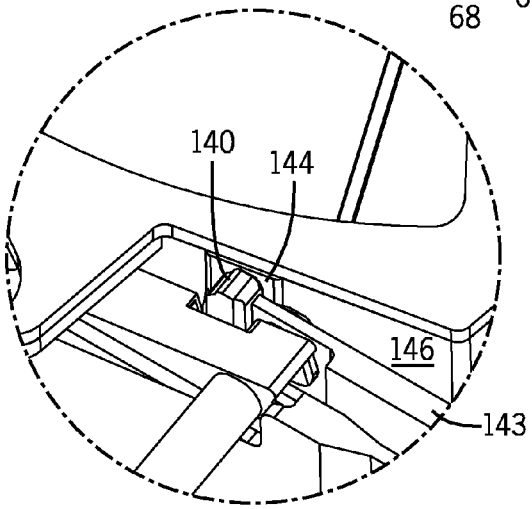
FIG. 10 is an isometric detailed view of the portion of FIG. 9 circumscribed by arc 10-10.

In operation, the print media cartridge (16) is inserted into the label printer (10) by inserting the tabs (30) extending from the print media cartridge (16) into the mating pockets (28) formed in the receptacle (26). A handle (148) of the print media cartridge (16) is then pushed toward the receptacle (26) causing the cartridge engagement surface (144) to engage the guide engagement surface (140), shown in FIGS. 9 and 10. The engagement moves the guide member (74) from the external media position toward the cartridge position.

In one form, the guide member (74) may be configured to releasably restrain the print media cartridge (16) within the receptacle (26). For instance, in cooperation with the mating pockets (28) and tabs (30), the guide member (74) may be biased into engagement with the print media cartridge (16) thereby restraining the print media cartridge (16). The guide engagement surface (140) of the guide member (74) may include a contoured portion configured to engage with a similar contoured portion of the cartridge engagement surface (144), such as a pair of interlocking nibs. In the example embodiment shown (and with reference to FIGS. 5 and 7 through 10), to fully insert the print media cartridge (16) into the receptacle (26), a distal end (147) of the cartridge engagement surface (144) must engage and pass beyond a tip (141) of the mating guide engagement surface (140). As a result, the print media cartridge (16) is restrained within the receptacle (26) by the guide member (74). To uninstall the print media cartridge (16) (such as by lifting the handle (148)), the guide member (74) must be pivoted about the path system axis (34) such that the distal end (147) of the cartridge engagement surface (144) urges against, biases, and passes by the tip (141) of the guide engagement surface (140). Once the distal end (147) and tip (141) are no longer in engagement, the tabs (30) of the print media cartridge (16) may be removed from the mating pockets (28), and the print media cartridge (16) removed from the receptacle (26).

One skilled in the art will appreciate the various configurations and form factors of similar guide engagement surfaces and cartridge engagement surfaces. For instance, the guide engagement surface (140) may include multiple protrusions spaced along the top face (142) or the guide engagement surface and cartridge engagement surface may be ramped, lobed, stepped, and the like. In other forms, the guide engagement surface or the cartridge engagement surface may be flat, with the other surface forming a protrusion to achieve the movement of the guide member (74). Alternatively, or in addition, the cartridge engagement surface and/or the guide engagement surface may be separate components from the respective print media cartridge (16) and guide member (74), as opposed from the integral components as shown.

Once the print media cartridge (16) is fully seated into the receptacle (26), the guide member (74) is advantageously moved out of engagement such that print media housed in the print media cartridge (16) may be fed through the label printer (10). The print media cartridge (16) includes a central spool (150) about which print media is unwound as the label printer (10) prints. The print media is unwound from the spool (150) and fed through an opening in the form of a slit (152) formed in an arm (156) extending from a shell (158) of the print media cartridge (16). In the illustrated example, the drive roller (120) and pinch roller (122) engage the print media upstream of the slit (152) (best shown in FIG. 9).

With specific reference to FIGS. 1 and 7 through 9, the arm (156) extending from the shell (158) of the print media cartridge (16) is preferably configured to engage a print media, such that installation of the print media cartridge (16) does not result in deformation (e.g., folding, bending, twisting) of the print media that extends from the central spool (150) into the slit (152), for instance. The slit (152) is formed in a transverse portion (153) that extends from a support plate (155), which is illustrated as integral with the shell (158). In the example shown, the transverse portion (153) extends approximately the width of the print media cartridge (16) (as viewed in FIG. 8). One skilled in the art, given the benefit of this disclosure, will appreciate the various arm (156) configurations available to secure the print media as the print media cartridge (16) is installed and removed from the receptacle (26).

Given the benefit of this disclosure, one skilled in the art will appreciate various modifications to the above concepts that may be made. For instance, the path system (22) may be configured to translate as opposed to rotate, such as by configuring the guide member (74) such that it is translated into the frame (12) as the print media cartridge (16) is installed. In another form, while not preferred, the guide member (74) may be manually moved from the external media position into the cartridge position. In still other forms, the entire print media cartridge (16) may be moved (e.g., rotated or slid on a mounting plate moveably coupled to the frame (12)) such that the guide member (74) can be biased or moved between the external media position and the cartridge position. For example, the print media cartridge (16) may be coupled to a moveable mounting plate that is translated within the frame by a motor coupled to the frame (12) in a rack-and-pinion fashion. A sensor may be positioned proximate the external media input passage (24) such that when print media is fed into the label printer (10) from an external source, the motor moves the mounting plate (and thus print media cartridge) such that the guide member (74) can move into the external media position. In still other versions, the guide member (74) may be translated or rotated by a motor.

While there has been shown and described what is at present considered the preferred embodiments of the invention, it will be appreciated by those skilled in the art, given the benefit of this disclosure, that various changes and modifications can be made without departing from the scope of the invention defined by the following claims.

We claim:

1. An adjustable print media path system capable of use in a printer, comprising:

a frame defining a receptacle and an external media input passage into which an external print media may be fed;

a print media cartridge configured to be insertable into the receptacle;

a cartridge engagement surface coupled to the print media cartridge;

a guide member moveably coupled to the frame between a cartridge position when the print media cartridge is inserted into the receptacle to guide cartridge print media and an external media position when the print media cartridge is not inserted into the receptacle at which the guide member is aligned with the external media input passage to guide the external print media that is fed into the external media input passage;

a guide engagement surface coupled to the guide member; and a biasing member urging the guide member toward the external media position;

wherein inserting the print media cartridge into the receptacle engages the cartridge engagement surface and the guide engagement surface, thereby moving the guide member from the external media position toward the cartridge position against the urging of the biasing member.

2. The adjustable print media path system of claim 1, wherein the guide member is pivotally coupled to the frame.

3. The adjustable print media path system of claim 1, wherein the print media cartridge further comprises:

a shell; and an arm extending from the shell;

wherein the arm is configured to engage the cartridge print media extending between the shell and the arm.

4. The adjustable print media path system of claim 1, wherein the biasing member is coupled to the frame and the guide member.

5. The adjustable print media path system of claim 1, wherein:

the cartridge engagement surface is integral with the print media cartridge; and the guide engagement surface is integral with the guide member.

6. The adjustable print media path system of claim 1, further comprising an inlet member coupled to the frame and positioned adjacent the guide member.

7. The adjustable print media path system of claim 1, wherein the guide member further comprises:

a print media passage between ends of the guide member;

a media restraint member adjacent the print media passage; and a biasing member urging the media restraint member toward the print media passage.

8. The adjustable print media path system of claim 1, further comprising:

a first roller supported by the frame and having a first axis;

a second roller supported by the frame and having a second axis positioned substantially parallel to the first axis; and an engagement plane defined between the first roller and the second roller that is oriented substantially perpendicular to a plane extending between the first axis and the second axis;

wherein when the guide member is in the external media position, the guide member defines an external media path; and wherein an entry angle defined between the external media path and the engagement plane is approximately less than fifteen degrees.

9. The adjustable print media path system of claim 8, wherein the first axis of the first roller is moveable relative to the second axis of the second roller.

10. The adjustable print media path system of claim 1, wherein the biasing member is a compression spring.

11. The adjustable print media path system of claim 1, further comprising:

a first roller supported by the frame and having a first axis;

a second roller supported by the frame and having a second axis positioned substantially parallel to the first axis; and an engagement plane defined between the first roller and the second roller that is oriented substantially perpendicular to a plane extending between the first axis and the second axis;

wherein the guide member includes a first print media passage along the guide member between ends of the guide member that defines a first external media path;

wherein a first entry angle defined between the first external media path and the engagement plane is approximately less than fifteen degrees when the guide member is in the external media position;

wherein the guide member includes a second print media passage along the guide member between the ends of the guide member that defines a second external media path; and wherein a second entry angle defined between the second external media path and the engagement plane is approximately less than fifteen degrees when the guide member is in the external media position.

12. The adjustable print media path system of claim 1, wherein when the print media cartridge is inserted into the receptacle, the guide member is biased into engagement with the print media cartridge by the biasing member to releasably restrain the print media cartridge within the receptacle.

13. A method of adjusting a print media path system, comprising:

providing a print media cartridge including a cartridge engagement surface;

providing a printer, comprising:

a frame defining an external media input passage into which an external print media may be fed; and a guide member moveably coupled to the frame between a cartridge position when the print media cartridge is inserted into the printer to guide cartridge print media and an external media position when the print media cartridge is not inserted into the printer at which the guide member is aligned with the external media input passage to guide the external print media that is fed into the external media input passage, the guide member including a guide engagement surface;

inserting the print media cartridge into the printer engages the guide engagement surface of the guide member and the cartridge engagement surface of the print media cartridge to move the guide member from the external media position to the cartridge position.

14. The method of adjusting a print media path system of claim 13, wherein:

the frame defines a receptacle; and inserting the print media cartridge comprises inserting the print media cartridge into the receptacle.

15. The method of adjusting a print media path system of claim 14, wherein the printer further comprises a biasing member positioned between the frame and the guide member to bias the guide member toward the external media position and further comprising removing the print media cartridge from the receptacle such that the biasing member returns the guide member to the external media position.

16. The method of adjusting a print media path system of claim 14, wherein when the print media cartridge is inserted into the receptacle, the guide member engages the print media cartridge to releasably restrain the print media cartridge in the receptacle.

17. The method of adjusting a print media path system of claim 13, wherein the guide member is pivotally coupled to the frame.

18. The method of adjusting a print media path system of claim 13, wherein:

the printer further comprises:

a first roller having a first axis;

a second roller having a second axis positioned substantially parallel to the first axis;

an engagement plane defined between the first roller and the second roller that is oriented substantially perpendicular to a plane extending between the first axis and the second axis; and a biasing member positioned between the frame and the guide member to bias the guide member toward the external media position;

removing the print media cartridge allows the biasing member to move the guide member to the external media position, the guide member defining an external media path defining an entry angle between the external media path and the engagement plane that is approximately less than fifteen degrees.

19. An adjustable print media path system capable of use in a printer having a print head assembly, comprising:

a frame defining a receptacle for selectively receiving a print media cartridge having cartridge print media;

an external media input passage into which an external print media may be fed;

a guide member defining an external print media passage adjacent to the external media input passage, the guide member is moveably coupled to the frame between an external media position and a cartridge position;

a biasing member urging the guide member toward the external media position;

wherein when the print media cartridge is not inserted into the receptacle the guide member is biased toward the external media position such that the external print media can be fed into the external media input passage and along the external print media passage of the guide member toward the print head assembly; and wherein when the print media cartridge is inserted into the receptacle the print media cartridge engages and moves the guide member to the cartridge position such that the cartridge print media can be fed to the print head assembly.

* * * * *